US005988035A

United States Patent [19]

Rossmann

[11] Patent Number: 5,988,035

[45] Date of Patent: Nov. 23, 1999

[54] SAWING CHAIN FOR CHAIN SAWS

[75] Inventor: Christoph Rossmann, Kitzeck i. Sausal, Austria

[73] Assignee: Hard-Stiftung, Vaduz/Liechtenstein

[21] Appl. No.: 08/851,512

[22] Filed: May 5, 1997

Related U.S. Application Data

[63] Continuation of application No. 08/256,408, filed as application No. PCT/EP93/03132, Nov. 9, 1993, abandoned.

[30] Foreign Application Priority Data

Nov. 9, 1992 [DE] Germany ..... 42 37 781

[51] Int. Cl.[6] ..... B26D 1/46

[52] U.S. Cl. ..... 83/830; 83/831; 83/832; 83/834

[58] Field of Search ..... 83/830, 831, 832, 83/833, 834; 30/166.3, 381

[56] References Cited

U.S. PATENT DOCUMENTS

| | | | |
|---|---|---|---|
| 614,003 | 11/1898 | Johnson | 83/831 X |
| 1,178,362 | 4/1916 | Wall | 83/831 |
| 1,483,387 | 2/1924 | Serin | 83/832 X |
| 1,634,643 | 7/1927 | Bens | 83/832 |
| 2,435,892 | 2/1948 | Mall | 83/830 |
| 2,583,243 | 1/1952 | Tweedie | 83/831 |
| 3,298,406 | 1/1967 | Erickson | 83/832 X |
| 3,945,289 | 3/1976 | Baez Rios | 83/831 X |
| 5,029,501 | 7/1991 | Smith | 83/830 X |
| 5,209,216 | 5/1993 | Mogi | 83/831 X |
| 5,226,404 | 7/1993 | Mogi et al. | 83/831 X |

FOREIGN PATENT DOCUMENTS

| | | | |
|---|---|---|---|
| 855018 | 11/1970 | Canada | 83/834 |

*Primary Examiner*—M. Rachuba

*Attorney, Agent, or Firm*—Jacobson, Price, Holman & Stern, PLLC

[57] ABSTRACT

A sawing chain for chain saws, having a plurality of chain links which are linked together so as to be mutually pivotable in a common plane of extent and advance (which plane is in the operating plane of the chain) and which links bear cutting elements. To facilitate replacement of damaged individual links, and to simplify the driving and guiding of the chain, the chain links are linked together in succession in a direct intermeshing fashion i.e. not relying on fasteners to mediate the linkage of the successive chain links, along edge surfaces which extend transversely to the common plane of extent and advance (which plane is in the operating plane of the chain), resulting in a chain structure which is resistant to flexure in the direction perpendicular to the plane.

20 Claims, 3 Drawing Sheets

SAWING CHAIN FOR CHAIN SAWS

This application is a file wrapper continuation of application Ser. No. 08/256,408, filed Jul. 11, 1994 now abandoned which is a 371 of PCT/EP93/03132 filed Nov. 11, 1993.

FIELD OF THE INVENTION

The invention relates to a sawing chain for chain saws.

BACKGROUND OF THE INVENTION

In sawing chains known heretofore, the individual links have been connected by longitudinal side plates which are riveted together from chain link to chain link. Under this arrangement, if an individual chain link becomes damaged a special tool is required to remove it.

In order to achieve the range of mutual swinging movement of the individual chain links which is required for proper saw operation, a certain play must be allowed between the individual side plates. However this play results in an undesired flexibility of the entire chain in the direction transverse to the common plane of extent and advance (hereinafter, "the operating plane") of the chain. In addition, in the common plane of the individual chain links, said links can flex to form angles in a certain range with respect to each other, with such flexing being in the nature of a kink. Consequently, the links can extend outward to a certain extent, under the action of reaction forces produced by the material being sawed.

Both of the undesired extra movements of the chain links are countered according to prior practice by providing a high chain tension. However, this causes substantially increased running resistance of the entire chain, thereby necessitating a high drive force.

Further, a consequence of the compliance of the chain in the operating plane transverse to the operating plane of the chain is constant contact between parts of the chain and the saw plate which bears them. This necessitates continuous lubrication of the respective contact surfaces, by continuous supply of pressurized oil from a pump, during operation of the saw. Apart from the cost and space requirements of this measure, the continuously supplied oil leads to undesired contamination of the sawdust, which complicates and renders more costly the environmentally benign disposal of said sawdust.

Accordingly, the underlying problem solved by the invention is to devise a saw chain of the type described above, such that excess movement of the chain links is prevented to the maximum extent. At the same time the mobility of the links which is required for proper operation is fully maintained such that individual chain links can be replaced without disturbing the connections of the other links and without the use of special tools.

SUMMARY OF THE INVENTION

A sawing chain according to the invention is comprised of links which can undergo tilting only in their common plane of operation i.e. the operating plane of the chain, only up to a desired detent point in their articulations. The result is a chain structure of coplanar form, and accordingly the sawing chain performs like a saw comprised of a unitary piece. Additional elaborate guide means are therefore unnecessary, and without such guide means the chain does not require lubrication.

All of the stresses on the sawing chain are resolved symmetrically. By virtue of the stiffening of the chain, the compression force of the cutting is no longer transmitted to the chain guide rail (or plate) but acts directly on the chain drive sprockets. Also at this location the surface of support of the chain against the rail or saw plate, which support acts in the plane of the chain in the direction normal to the chain path, the need for chain lubrication is obviated. The chain can thus be kept dry, and will accumulate correspondingly less dust. The chain is still subject to accumulation of rosin during operation, but such material can be removed from the contact surfaces by stripping plates disposed on the sides of the chain links.

The sawing chain can operate without pre-tensioning, and it can operate with equal effectiveness in either direction of advance. The energy consumption is so low that an electric storage battery may be used for power. The operating speed is so low that even in the event of derailment or rupture of the chain there is no danger of a mishap due to flying parts. Further, the slow speed means that in an emergency the chain can be stopped quickly. Moreover the increases the durability of the cutting elements.

The individual chain links are formed such that when they are linked together with their hooked members all of the forces which arise during operation, such as longitudinal tension force, operating compression force, lateral torsion, and lateral warping, are borne by pure compression without sliding friction. The corresponding engaging surfaces roll over each other. All relative movements such as movements which would produce sliding friction at these engaging surfaces between chain links are ended before these surfaces come into contact. At the same time, the individual chain links can be de-linked by merely inclining them with respect to each other to an angle beyond the maximum angle of inclination which occurs during sawing, so that no tools are needed. Thus, damaged chain links can be replaced easily and quickly.

A smooth cutting surface on the material being sawed can be achieved with the aid of the disparate cutting elements provided according to the invention. This surface is free of steps or ridges and resembles a planar surface.

For further elucidation of the invention, reference will be made to the drawings, which illustrate a preferred embodiment of the invention and variants thereof.

PREFERRED EMBODIMENT

Figure 2:
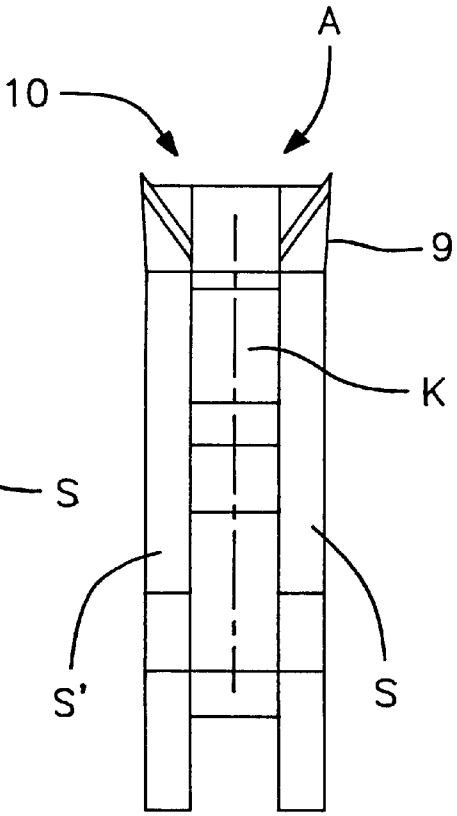
FIG. 2 is an end view of a chain link.
Figure 1:
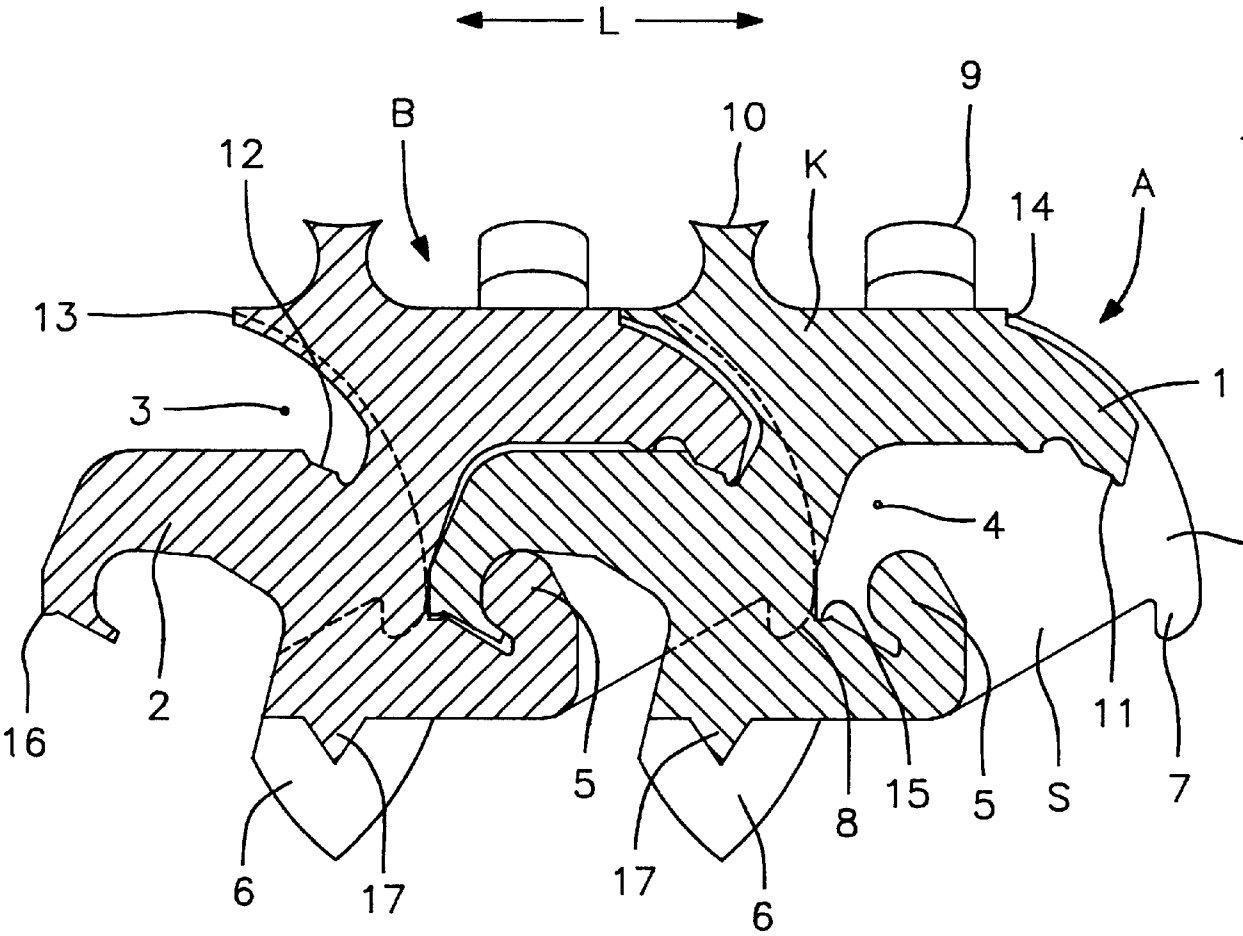
FIG. 1 shows two mutually engaged chain links in an extended operating position, in a side view after removal of one of the side pieces on each link.
Figure 5:
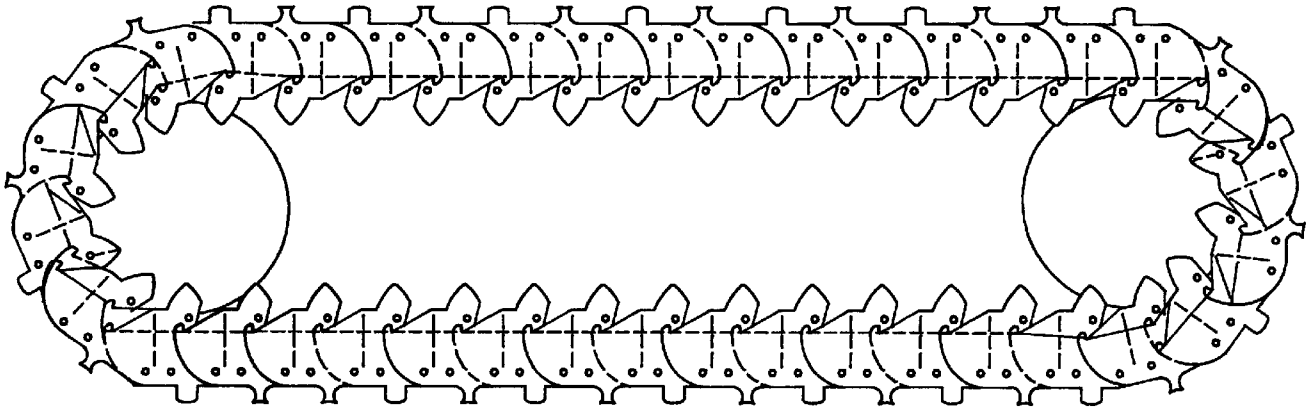
FIG. 5 is a variant embodiment of a sawing chain according to the invention, showing the overall configuration of the chain running over two sprocket wheels.

In FIG. 1, two mutually engaged links (A, B) are shown, each of which in the manner shown in FIG. 2 for link A, is comprised of a central core piece K and two outer, side pieces (S, S'), wherewith to more clearly show the configuration of the core piece K the side piece S' for each link has been omitted in FIG. 1. The core piece K and the side pieces (S, S') may each be comprised of a plurality of pieces of sheet metal which have been riveted together e.g. in a laminated construction. The double arrow L in FIG. 1 indicates the running direction of the sawing chain comprised of a plurality of such chain links (FIG. 5). Sawing is equally possible and equally effective with the chain links moved from left to right and from right to left.

In all chain links the core piece K and the side pieces (S, S') are respectively identically configured from link to link. Moreover, the configuration of the side pieces S and S' is identical except that they are mirror images. Accordingly, hereinbelow only the core piece K and the side piece S of link A are described in detail.

Figure 3:
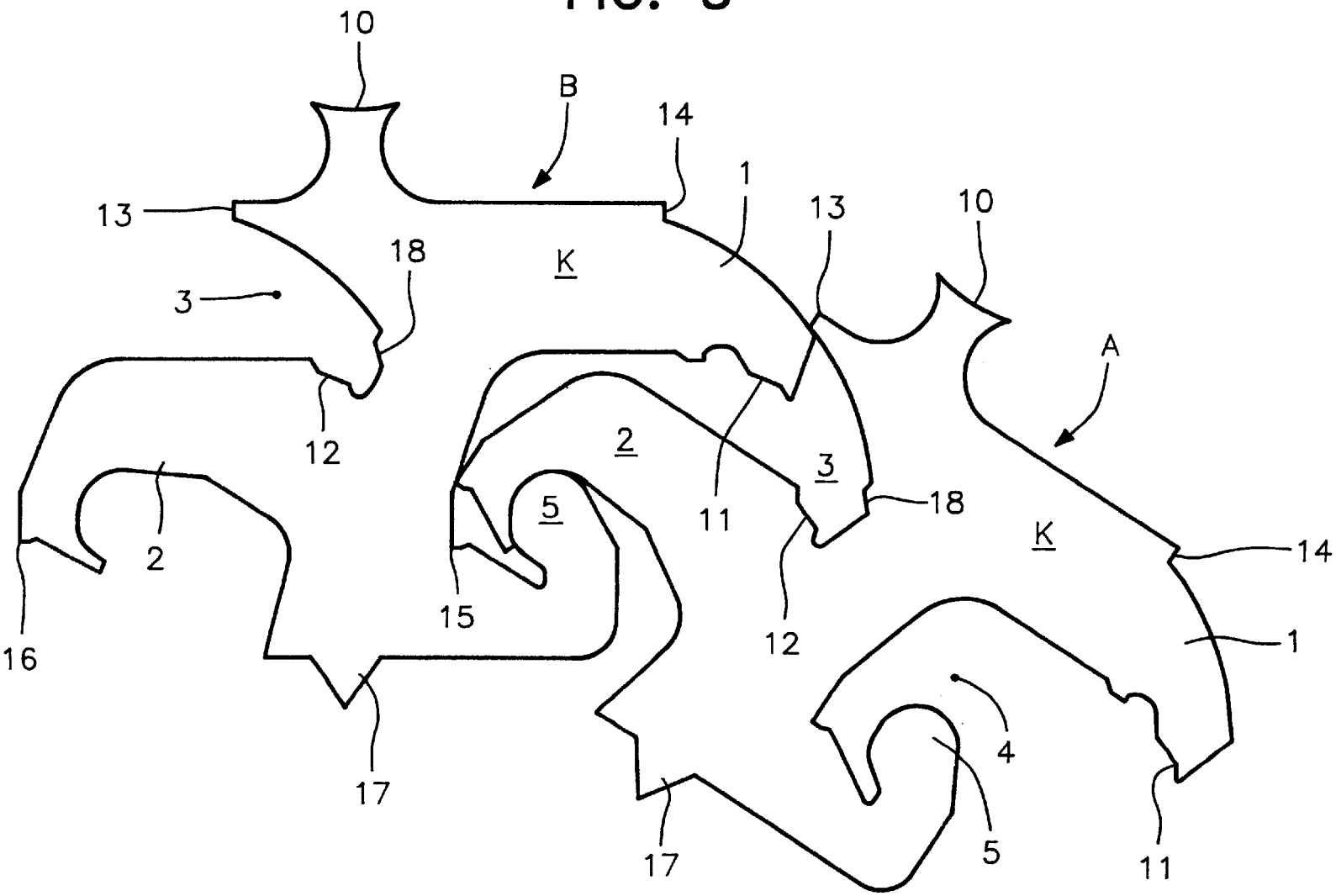
FIG. 3 shows the core pieces of two mutually pivotably connected chain links in a mutually inclined position which is still tolerable during saw operation.
Figure 4:
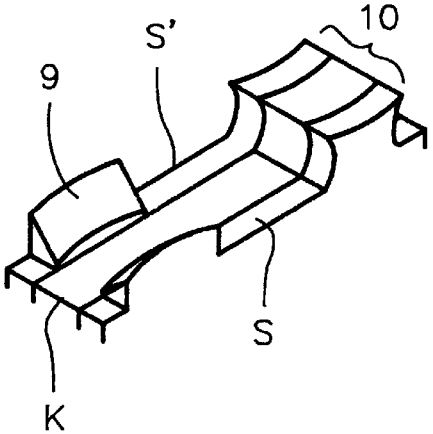
FIG. 4 is a perspective view of two distinct cutting elements.

As seen from FIGS. 1 and 3, the core piece K has a straight upper edge and a straight lower edge. A wedge-shaped drive tooth 17 extends downward from the lower edge as a means of transmitting drive force to the sawing chain. A cutting element is formed on the upper edge, which cutting element in the example illustrated is the middle core part of a raker tooth 10 which tooth extends over the side pieces S and S' which adjoin the core piece K, as illustrated in FIGS. 2 and 4.

On its right or front edge as shown in FIG. 1, the core piece K of chain link A has a projection 1 which undergoes a transition to a step configuration 14 at its top edge approaching the top edge of the core piece K, and at its free end tapers off into a downwardly directed nose 11 which is still above the longitudinal middle axis of the chain link A. Corresponding to this projection 1 there is a "rearwardly" directed upper recess 3 formed in each core piece K. In the assembled sawing chain, recess 3 accommodates the projection 1 of the "following" core piece K, as shown for the two links A and B in FIG. 1. Near the inner base of the recess 3 is an angled surface 12, and a corresponding configuration is present on the nose 11 on the free end of the projection 1. Further, a beak member 13 is present on the upper end of the recess 3 at the transition to the upper edge of the core piece K. In the assembled sawing chain, this beak interacts with the step 14 on the next "following" core piece K, as is seen from FIG. 1.

In the embodiment illustrated in FIG. 3, a constriction 18 is located on the upper edge of the recess 3 near the interior end of the recess. This constricts the recess 3 so as to clampingly engage the associated projection 1 and hold projection 1 against the angled surface 12 of the recess 3.

A hook 2 extends from the lower edge of the core piece K. The free end of hook 2 is bent downward and "forward". Said free end is disposed below the longitudinal axis of the core piece. A lower recess 4 is provided on the "front" end of the core piece K, which recess corresponds to the hook 2. In the assembled chain the recess 4 accommodates the hook 2 of the next "leading" core piece K. Each recess 4 has a notch 15 on its base end, which notch corresponds in position, orientation, and shape to a projection 16 formed on the "rear" end of the corresponding hook 2. An articulation shaft 5 with curved surfaces directed upwardly and "rearwardly", which shaft has generally a comma shape, is formed in the lower region of the recess 4. In the assembled chain the shaft 5 fits into the interior recess of the hook 2 of the next "leading" core piece K, as is seen in FIG. 1 for the chain links A and B.

The curved surfaces of the mutually engaging members of all the core pieces K are preferably circular i.e. cylindrical. However, the radii of these circular arcs differ from those of the corresponding surfaces, and/or the centers of these circular arcs are displaced from the centers for the corresponding surfaces, so that all relative tangential sliding movement ends prior to actual contact of the surfaces. When the surfaces of a given pair of mutually engaging members are brought into contact they undergo frictionless rolling movement over each other. In this connection, gradually closing gaps are produced between the mutually engaging surfaces. Accordingly, fine soils which appear during sawing are pushed to the ends of the contact surfaces and are removed.

As mentioned, sawing can be carried out equally effectively in the "forward" direction with movement of the links A and B rightward as in FIG. 1, or in the "rearward" direction with movement of the links A and B leftward as in FIG. 1. The operating compression force in either case acts downward from above, onto the articulation shaft 5 which serves as the initial pivot point (FIG. 1). As a result the hook 2 at the region of its projection 16 presses against the region of the boundary of the recess 4 which region adjoins the notch 15. The hook 2 then cannot be rotated further around the initial pivot point 5, and the contact surfaces between the hook 2 and the boundary of the recess 4 now serve as the new pivot location, such that the interior concave surface of the hook 2 is forcibly lifted off of the articulation shaft 5, until the beak member 13 comes to abut against the step 14, with accompanying transmission of compression forces to the contact surfaces of structures 13 and 14. The operating tension in the sawing chain in the given sawing direction is subtracted from the transmitted compression forces at (13, 14). Thus the tension in the saw chain is borne by the contact surfaces between the projection 1 in the region of the nose 11, and the boundary of the recess 3, in the region of the angled surface 12. In the process, independently of the sequence of the links (A,B) in the path of the sawing chain, i.e. independently of whether the sawing direction in a given case is rightward or leftward in the direction of the double arrow L, only compressive stresses occur at all contact surfaces. Elastic deformations such as bending of the hook 2, the projection 1, or the beak member 13 are prevented by the presence of the respective opposing surfaces, and thereby all forces are borne as compressive forces.

The cooperation of the various contact surfaces leads to a structure which is resistant to flexure transversely to the plane of operation of the chain. However, in the plane of operation of the chain, mutual inclination of the chain links (A,B) is possible, as illustrated in FIG. 3. Further inclination of the link A beyond the position illustrated in FIG. 3 enables de-linking of link A from link B, and thereby removal of one or more links from the chain, without the need for special tools.

The confinement of each core piece K between two side pieces (S, S') (FIGS. 1 and 2) serves to counter mutual lateral translation of the links as shown A,B transversely to the plane of operation of the chain. The side pieces (S, S'), which are identical in shape and size except for being mirror images of each other, have a shape which differs from that of the confined core piece K. However, the side pieces too can be linked together to form an assembly chain which is closed and is resistant to flexure transversely to the plane of operation of the chain, but allows mutual inclination of the links. For this purpose, each side piece (S; S') bears a downwardly directed interlocking projection 7 on its "forward" edge which matches a recess 8 provided on the "rear" edge, so that the interlocking projections 7 for the side pieces (S, S') of the next "following" chain link B engage into the recesses 8 in the side pieces (S, S') of the "leading" chain link A, thereby linking the respective side pieces. In addition, each side piece (S, S') has a downwardly projecting guide lug 6 which acts to guide the sawing chain on the chain sprockets.

Cutting teeth 9 are provided as cutting elements on the chain links (A, B), in addition to the rakers 10 mentioned above. FIG. 5 shows periodically alternating disposition of these cutting teeth 9. In the chain of FIG. 5 each link has only one type of tooth, either a cutting tooth 9 or a raker 10, whereas in the chain of FIG. 1 each link has two cutting teeth 9 and a raker 10. In both exemplary embodiments shown, the work of sawing is distributed between the two different types of teeth, which act in succession. It is further possible to provide more than two types of teeth; and it is desirable if individual links can be accommodated which have no cutting elements.

The shapes of the cutting teeth 9 and rakers 10, and their disposition on the links, can be seen most clearly in FIG. 4. In particular it may be seen there that the cutting teeth 9 are borne on the side pieces (S, S'), whereas the rakers extend laterally over the side pieces (S, S') and the core piece K.

The cutting edges of the cutting teeth 9, which teeth generally narrow in wedge fashion with progression upward and outward, extend parallel to the operating plane of the sawing chain, and they have a symmetric shape along the direction L of operation of the chain i.e. with respect to a vertical transverse midplane. They have a sickle-shaped curvature extending upward and outward. In this way, the cutting teeth 9 cut to a prescribed depth into the material being sawed, and provide a smooth, step-free sawing surface.

In the example shown in FIG. 4, the raking teeth 10 have two mutually parallel cutting edges which extend at a 90° angle transversely to the operating direction L of the chain. They work analogously to planing irons. Alternatively to the form of cutting edges shown, it is possible to have cutting edges of a symmetrical arrow shape or a notch shape, or cutting edges which are straight but extend obliquely to the operating direction L of the chain.

Means may be provided whereby one may interchangeably affix the cutting teeth 9 and rakers 10, and other completely different cutting elements, to the chain links (A, B).

In principle, the invention may be described as a sawing chain for chain saws, having a plurality of chain links bearing cutting elements, which links are coupled so as to be mutually articulable in their common plane of operation.

According to the invention, to facilitate replacement of individual links which have become damaged and to simplify the guiding and driving of the chain, the chain links are linked together in succession in a direct intermeshing fashion i.e. not relying on fasteners to mediate the said linkage of the successive chain links, along edge surfaces which extend transversely to the common plane of extent and advance, i.e. transversely to the operating plane of the chain, resulting in a chain structure which is resistant to flexure in the direction perpendicular to the said plane.

In a preferred embodiment, each chain link has a structure comprising at least three layers, with an inner core piece and two side pieces. Each core piece has an outwardly and eventually downwardly directed curved-beak-like projection at its "forward" edge, the edge in the direction of forward movement of the chain, and has a hook-like projection at its corresponding "rearward" edge which latter projection is outwardly and eventually downwardly directed and which eventually bends back in the "forward" direction. Further each core piece has an upper "rear" recess shaped complementarily to the said beak-like projection, to accommodate the beak-like projection of the next "following" core piece in the direction of the chain path, and a lower "forward" recess which terminates in an articulation shaft for pivotably engaging the hook-like projection of the next "leading" core piece in the direction of the chain path.

Further, at least two types of teeth may be provided as cutting elements borne on the chain links, which teeth have respectively differently directed cutting edges and are disposed in periodic alternation along the path of the chain. Wherewith preferably the teeth of one type are cutting teeth and the teeth of the other type may be raking teeth.

I claim:

1. A sawing chain for chain saws, said sawing chain comprising:

a plurality of chain links releasably coupled to each other and pivoted with respect to each other, each of said plurality of chain links including cutting elements, said chain links forming a structure resistant to bending against a cutting force and moving transverse to a common running plane, adjacent chain links meshing with each other at a joint and forming several pairs of surfaces located within the common running plane and engaging with each other, and an additional laterally acting linking being located between the chain links to avoid lateral movement when the chain links are reversed in direction, a center of the joint being located spaced from a radial center line of the chain, and upon straightening of adjoining chain links, three pairs of surfaces are located in a triangle shape within the common running plane in engagement with each other along outside edge surfaces extending perpendicular to the common running plane and without a load being placed on the joint.

2. A chain according to claim 1, wherein each chain link has at least three layers including an inner core piece and two side pieces.

3. A chain according to claim 2 wherein the two side pieces are of identical shape.

4. A chain according to claim 2, wherein each core piece includes a projection curving downwardly in a beak configuration at a forward edge and a hook extending from a rearward edge and further each core piece has an upper and rear recess shaped complementary to said projection, and a lower and front recess terminating at a joint bolt for hooking on the hook of a preceding core piece.

5. A chain according to claim 4, wherein the projection and the associated upper recess on each core piece has a three-point contact between the core pieces of two successive chain links, whereas the hook and the lower recess associated therewith have contact between the core pieces of two successive chain links.

6. A chain according to claim 4, wherein each upper recess has a constriction in an upper end for clamping an upper outer comer of an associated projection.

7. A chain according to claim 4, wherein the projection has at a free end a downwardly inclined nose, and an associated upper recess has a corresponding upwardly and forwardly inclined bevel portion.

8. A chain according to claim 4, wherein an upper edge of the upper recess terminates in a rearwardly directed horn member, and a correspondingly shaped saddle.

9. A chain according to claim 4, wherein the lower recess has a downwardly directed notch on a rearward end of the hook and a downwardly directed projection.

10. A chain according to claim 4, wherein the hook and the lower recess on each core piece extend up to below a longitudinal middle axis of the core piece; and the projection and the upper recess extend from the upper edge of the core piece, toward the longitudinal middle axis.

11. A chain according to claim 4, wherein the projections, hooks, and recesses of the core pieces of successive chain links mesh with each other and arc curved to allow release of only one chain link from adjoining links when pivoted beyond a maximum pivot angle occurring during a sawing operation.

12. A chain according to claim 4, wherein meshing of the projections, hooks, and recesses of the core pieces of successive chain links maintains respective spacings and permit self-cleaning of the chain in operation.

13. A chain according to claim 12, wherein corresponding surfaces of the core pieces of successive chain links extend along circular arcs around mutually offset center points with different radii.

14. A chain according to claim 2 wherein the core piece of each chain link has a wedge-shaped projecting drive tooth on a lower side.

15. A chain according to claim 2, wherein the side pieces of all chain links have a flat surface on an upper side, have at least one guide fin on a lower side, and have a curved locking nose on an edge extending transverse to a running direction of the chain and a corresponding recess on an opposite edge.

16. A chain according to claim 1, wherein the chain links including cutting elements having at least two types of teeth with cutting edges differing from each other and following each other along a course of the chain.

17. A chain according to claim 16, wherein the teeth differ from each other in at least one of a form and a position of cutting edges.

18. A chain according to claim 16, wherein at least some of the chain links are provided with a plurality of teeth of different types.

19. A chain according to claim 16, wherein the teeth are connected with the chain links.

20. A chain according to claim 16, wherein the teeth of one type extend over the core piece and side pieces of the chain links, whereas the teeth of another type are disposed on the side pieces of the chain links.

* * * * *